United States Patent [19]

Freeman

[11] Patent Number: 4,891,876

[45] Date of Patent: Jan. 9, 1990

[54] METHOD OF MAKING PUMP IMPELLER BY LOST-FOAM MOLDING

[75] Inventor: Richard R. Freeman, Ardens Grafton, England

[73] Assignee: Concentric Pumps Limited, United Kingdom

[21] Appl. No.: 310,907

[22] Filed: Feb. 16, 1989

[30] Foreign Application Priority Data

Mar. 1, 1988 [GB] United Kingdom ..... 8804794

[51] Int. Cl.[4] ..... B21K 3/04

[52] U.S. Cl. ..... 29/156.8 R; 29/DIG. 29; 164/34; 164/98

[58] Field of Search ..... 29/156.8 R, 156.8 CF, 29/156.8 FC, 156.8 B, 156.8 P, 156.8 T, DIG. 29; 164/34, 35, 98; 264/51, 53, 227; 249/59

[56] References Cited

U.S. PATENT DOCUMENTS

| | | | |
|---|---|---|---|
| 2,793,412 | 5/1957 | Lashbrook | 164/34 |
| 3,388,749 | 6/1968 | Woods et al. | 29/156.8 R |
| 3,734,697 | 5/1973 | Sieghartner | 29/156.8 R |
| 3,889,737 | 6/1975 | Olsen | 164/34 |
| 4,375,233 | 3/1983 | Rossmann et al. | 164/98 X |
| 4,693,292 | 9/1987 | Campbell | 164/34 |

*Primary Examiner*—Joseph M. Gorski
*Assistant Examiner*—Peter Vo
*Attorney, Agent, or Firm*—Learman & McCulloch

[57] ABSTRACT

A method of casting a water pump impeller which initially includes the formation of a foam pattern incorporating a former which remains as a part of the impeller, the foam pattern being used to form a mold in which the impeller is cast accompanied by the destruction of the foam pattern.

5 Claims, 2 Drawing Sheets

METHOD OF MAKING PUMP IMPELLER BY LOST-FOAM MOLDING

This invention relates to water pumps and more especially the impellers thereof, as used in internal combustion engines. Such an impeller comprises a disc or cage extending from a hub and carrying a plurality of impeller blades.

Modern I.C. engines utilise pressurised coolant systems, so that although the coolant may be water, the temperature can be above 100 deg. C. However, the impeller is necessarily fast with a drive shaft which is in heat conducting contact with engine parts which may be at substantially higher temperatures, and this creates problems in the design which are only solved at present by relatively expensive manufacturing techniques both for the impeller per se and its securement on the drive shaft therefor. The object of the invention is to solve these problems and allow more economical production.

According to a first aspect of the invention, a water pump impeller is made by a method comprising the steps of (i) making a female die complementary to the impeller shaft (ii) filling the die with foam and allowing or causing the same to set in the shape of the die (iii) using the foam shape as a pattern to create a mould cavity with the foam shape contained therein and (iv) filling said cavity with molten metal to form the impeller to the shape of the cavity and simultaneously destroy the foam shape, the shape being located on a former throughout steps (ii)–(iv).

The foam may be made by filling the die with polystyrene beads and injecting steam. The shape may then be coated by dipping into a ceramic slurry which is allowed to dry.

Preferably the metal is iron.

The former may be a die insert which may be of stainless steel in the form of a short tube with radial outwardly extending flanges at one or both ends and with one or more peripheral and external ribs or other projections. This forms a central hole in the foam and acts as a support for the same during transfer from the die and location in the mould. The iron then casts onto the insert and the impeller becomes axially keyed to the insert by the ribs or contained by the flanges.

The insert may be dimensioned so that in use it, with the impeller formed thereon, is a drive or interference fit on the shaft.

Alternatively, the shaft itself may be used as the former on which the foam is formed, so that the impeller is later cast directly onto the shaft. This avoids the use of any intermediary between the shaft and the impeller.

The invention is now described with reference to the accompanying drawings wherein.

Figure 1:
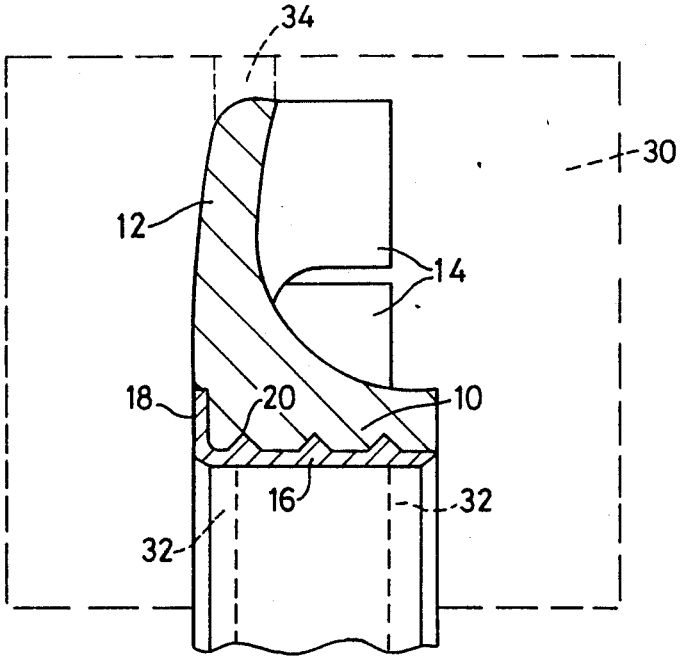
FIG. 1 is a sectional elevation showing an impeller with a first kind of insert.

All of the impellers shown in the drawings comprise a tubular hub portion 10 which is integral with a disc 12 carrying a set of curved impeller vanes 14. The shape and contours of the hub, disc and vanes form no part of this invention.

Figure 2:
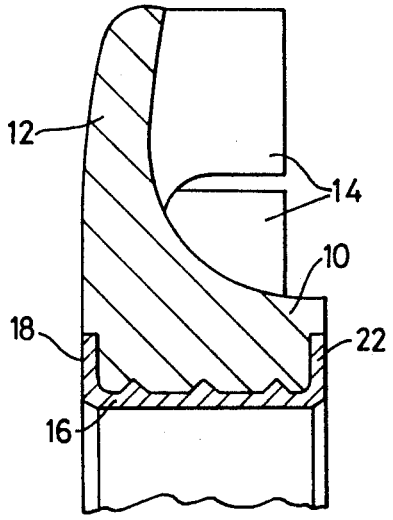
FIG. 2 is a similar view with a second kind of insert.
Figure 3:
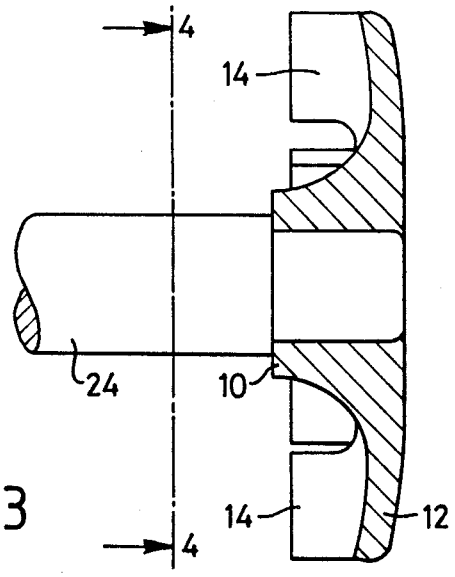
FIG. 3 shows the same kind of impeller but cast direct to a shaft.
Figure 4:
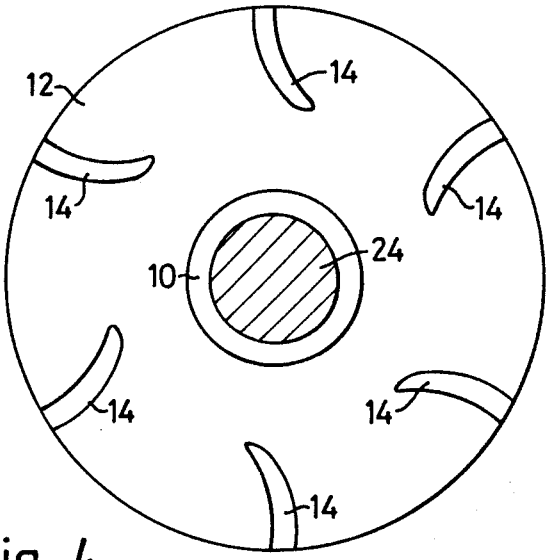
FIG. 4 is a view on the line 4 4 of FIG. 3.

In FIG. 1 the hub 10 is mounted on a former which as illustrated in FIGS. 1 and 2 is a stainless steel tube 16 made integral with end flange 18 and with keying ribs 20. In FIG. 2 there are two flanges 18 and 22. In FIGS. 3 and 4 the impeller is cast directly on the shaft 24.

In manufacture according to the invention, a female die 30 shown in phantom in FIG. 1 has a cavity complementary to the impeller including co-axial stubs 32 to receive, locate and position the tube 16. The die may be in two parts which are diametrically split or axially separable. When closed, and with insert in position, material is injected to fill the cavity with foam and take the required shape of the impeller, and this is allowed or caused to cure. The material may be injected for example through a port 34.

The foam pattern of the impeller is coated with suitable material to provide a required surface finish and is then used to make a so-called sand casting for example though it could alternatively be used as a pattern for a shell mould, which in either case will generally assume the position and shape of the die 30 in FIG. 1. Iron (for example) is cast into the cavity formed by the mould, sand or sand equivalent, and thus cause destruction of the foam which becomes replaced by the iron.

The impeller of FIG. 2 differs only in the nature of the insert, the insert shown including a pair of peripheral flanges 18 and 22 as previously referred to.

In the case of FIGS. 3 and 4, the die is adapted to support and locate the shaft 24 so that as well as FIG. 1 representing the impeller made of cast iron, it may equally well represent the foam pattern made thereon prior to the casting step. The subject mould making step is the same for FIG. 3 as for FIG. 1.

The impeller of the present invention does not need machining and is effectively ready for use when cast.

I claim:

1. A method of making a water pump impeller having a tubular hub portion provided with a central axial aperture, a disc portion integral with said hub portion, and impeller vanes integral with said disc portion, said method comprising:

(a) forming a female die complementary to the shape of the impeller to be made;

(b) positioning a former in said die to be located in said central axial aperture of the tubular hub portion of the impeller to be made;

(c) filling said die with curable foam-like material thereby forming an impeller pattern which is mounted upon said former;

(d) curing said foam-like material of said pattern and removing said pattern from said die;

(e) using said pattern to form an impeller casting mold; and (f) casting said impeller in said mold during which the cured foam-like material of said pattern is destroyed without destroying said former and maintaining the former in said central axial aperture of the tubular hub portion of said impeller.

2. The method of claim 1 wherein said foam-like pattern after curing is coated with a surface finishing material prior to the forming of said mold, and said impeller is cast from molten metal in said mold.

3. The method of claim 1 wherein said former is tubular and provided with at least one radial projection which becomes embedded in said pattern and thereafter in said hub portion of said impeller.

4. The method of claim 3 wherein said former is further provided with at least one outwardly projecting flange along at least one periphery thereof, which flange engages said pattern and said ultimately cast impeller hub portion.

5. The method of claim 1 wherein said former is a drive shaft for the ultimately cast impeller.

* * * * *